US005860843A

United States Patent [19]

Kasahara

[11] Patent Number: 5,860,843

[45] Date of Patent: Jan. 19, 1999

[54] METHOD OF MANUFACTURING A PLASMA DISPLAY PANEL

[75] Inventor: Shigeo Kasahara, Kawasaki, Japan

[73] Assignee: Fujitsu Ltd., Kawasaki, Japan

[21] Appl. No.: 812,046

[22] Filed: Mar. 6, 1997

[30] Foreign Application Priority Data

Oct. 15, 1996 [JP] Japan ..... 8-272000

[51] Int. Cl.[6] ..... H01J 9/24

[52] U.S. Cl. ..... 445/24

[58] Field of Search ..... 445/24

[56] References Cited

U.S. PATENT DOCUMENTS 5,011,391 4/1991 Kawasaki et al. ..... 445/24

FOREIGN PATENT DOCUMENTS 249828 9/1992 Japan ..... 445/24

282531 10/1992 Japan ..... 445/24

*Primary Examiner*—Kenneth J. Ramsey

*Attorney, Agent, or Firm*—Staas & Halsey

[57] ABSTRACT

Disclosed are a plasma display panel and a manufacturing method therefor. According to the present invention, a method for manufacturing a plasma display panel comprises the steps of: forming a plurality of electrodes on insulating substrates; forming a conductive paste layer on the insulating substrates ; forming a masking film on the paste layer at locations between the electrodes; forcefully impelling particles against the paste layer to remove, by etching, portions of the paste layer where the masking film is not deposited; and exposing the paste layer to an annealing atmosphere so as to form partition walls between the electrodes.

14 Claims, 7 Drawing Sheets

METHOD OF MANUFACTURING A PLASMA DISPLAY PANEL

BACKGROUND OF THE INVENTION

1. Field of the Invention

The present invention relates to the structure of a plasma display panel, and to a manufacturing method therefor; and in particular to the structure of barrier ribs (partition walls) formed between address electrodes to define a plasma discharge space, and to a manufacturing method therefor.

2. Related Arts

As part of the structure of a surface discharge three-electrode plasma display panel, a pair of display electrodes are provided along a display line on a front glass substrate, and a plurality of address electrodes that are perpendicularly positioned relative to the display electrode pair are provided on a rear glass substrate. The two glass substrates are positioned facing each other and are sealed together with a discharge space between them. A portion whereat the display electrode pair and the address electrodes intersect is a display cell area. A discharge (an address discharge) is performed between the display electrodes and the address electrodes, and a wall charge that is generated by the discharge is employed to perform a sustained discharge between the display electrodes.

Partition walls (barrier ribs) made of insulating material are formed between the address electrodes in order to prevent the address discharge from exerting an undesirable influence on adjacent cells. Fluophors formed on the address electrodes and between the partition walls are irradiated by ultraviolet rays generated by the plasma discharge, and various colored light beams are emitted by the fluophors to provide a display.

FIGS. 6A and 6B are cross-sectional views of the essential portion showing a process employed for forming ordinary partition walls. As is described above, a plurality of address electrodes 7 are formed on a rear glass substrate 6, and a dielectric layer 10 is formed thereon by using screen printing to apply a glass paste layer and thereafter subjecting the layer to an annealing process. A partition wall layer 8, formed of a glass paste having a low melting point, is coated on the resultant structure by screen printing, and is dried. Then, a dry film made of photosensitive material is adhered thereto. Exposure and development is performed on the resultant structure so that dry film layers 11 remain in regions where partition walls are to be formed. The cross-sectional view of FIG. 6A shows this state.

In order to perform the patterning of a thick partition wall layer 8 composed of a dry glass paste, following this, as is shown in FIG. 6B, fine particles 13 of alumina or silica are forcefully expelled from an air nozzle 12 to remove the exposed portions of the partition wall layer 8 by etching. This is a widely known sandblasting procedure that can satisfactorily form a comparatively thick partition wall.

However, with the sandblasting procedure, when the particles are expelled and strike the partition wall layer 8, contact electrification occurs, so that the grains and the surface of the partition wall layer 8 acquire negative and positive charges, for example. As a result, as is shown in the cross-sectional view in FIG. 7, when the sandblasting procedure is terminated, some of the material used for partition walls, or some of the abrasive particles, remains as a residual substance 8*a* on the dielectric layer 10 covering the address electrodes 7.

It has been substantially confirmed that accumulation of the residual substance 8*a* is caused by contact electrification.

However, precisely how contact electrification causes the residual substance 8*a* to accumulate on the address electrodes 7 is not yet known. But since the residual substance 8*a* mainly accumulates on the address electrodes 7, as is shown in FIG. 7, it is felt that a reaction between the electric charges acquired by the wall material and the abrasive particles and the electric potential of the address electrodes 7 causes the abrasion rates to differ.

When on a structure there is residual substance 8*a* remaining following the sandblasting procedure which is difficult to remove, and this structure and the front glass substrate are assembled together, the presence of the residual substance 8*a* causes the characteristics of the cells at the intersections of the display electrodes and the address electrodes to be ununiform.

SUMMARY OF THE INVENTION

It is, therefore, one object of the present invention to provide a manufacturing method whereby no residual substance is accumulated even when the sandblasting procedure is employed for patterning a partition wall layer, and a plasma display panel therefor.

It is another object of the present invention to provide a manufacturing method whereby a uniform etching rate can be maintained when the sandblasting procedure is performed for patterning a wall partition layer, and a plasma display panel therefor.

To achieve the above objects, according to the present invention, a method, for manufacturing a plasma display panel that has a pair of insulating substrates facing each other with an intervening discharge space and that provides a display by generating a discharge of plasma between electrodes formed on the insulating substrates, comprises the steps of:

forming a plurality of electrodes on the insulating substrates;

forming a conductive paste layer on the insulating substrates;

forming a masking film on the paste layer at locations between the plurality of electrodes;

forcefully impelling particles against the paste layer to remove, by etching, portions of the paste layer where the masking film is not formed; and exposing the paste layer to an annealing atmosphere so as to form partition walls between the plurality of electrodes.

Further to achieve the above objects, according to the another invention, a method, for manufacturing a plasma display panel that has a pair of insulating substrates facing each other with an intervening discharge space and that provides a display by generating a discharge of plasma between electrodes formed on the insulating substrates, comprises the steps of:

forming a plurality of electrodes on the insulating substrates;

forming a conductive thin film on the insulating substrates;

forming a paste layer on the conductive thin film;

forming a masking film on the paste layer at locations between the plurality of electrodes;

forcefully impelling particles against the paste layer to remove, by etching, portions of the paste layer where the masking film is not formed; and exposing the paste layer to an annealing atmosphere so as to form partition walls between the plurality of electrodes.

Preferably, conductivity of the paste layer or the thin film would be reduced at the step at which the paste layer is exposed to the annealing atmosphere.

According to the manufacturing method, in the sandblasting procedure for forming a barrier rib layer, the conductivity of the paste layer, or of the thin film formed under, the paste layer enables the free movement of electric charges that are generated due to the collision electrification, and a uniform etching rate can be obtained regardless of the presence of the address electrodes.

Organic polymer, organic charge transfer complexes consisting of an electron donor and an electron acceptor, conductive oxide, or metal can be employed as conductive materials.

DETAILED DESCRIPTION OF THE PREFERRED EMBODIMENTS

The preferred embodiments of the present invention will now be described while referring to the accompanying drawings. It should be noted that although they are preferred embodiments, the embodiments can not be considered as imposing any limits on the technical scope of the present invention.

Figure 1:
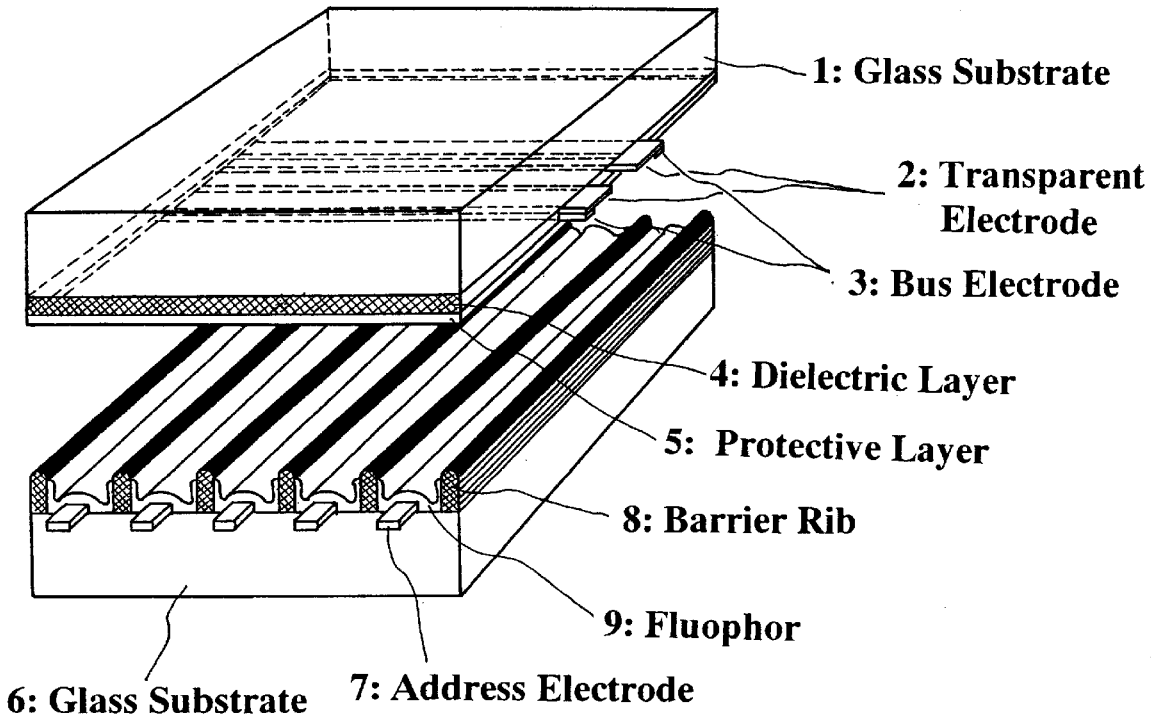
FIG. 1 is an exploded perspective view of the schematic structure of a plasma display panel of a three-electrode surface discharge type.
Figure 2:
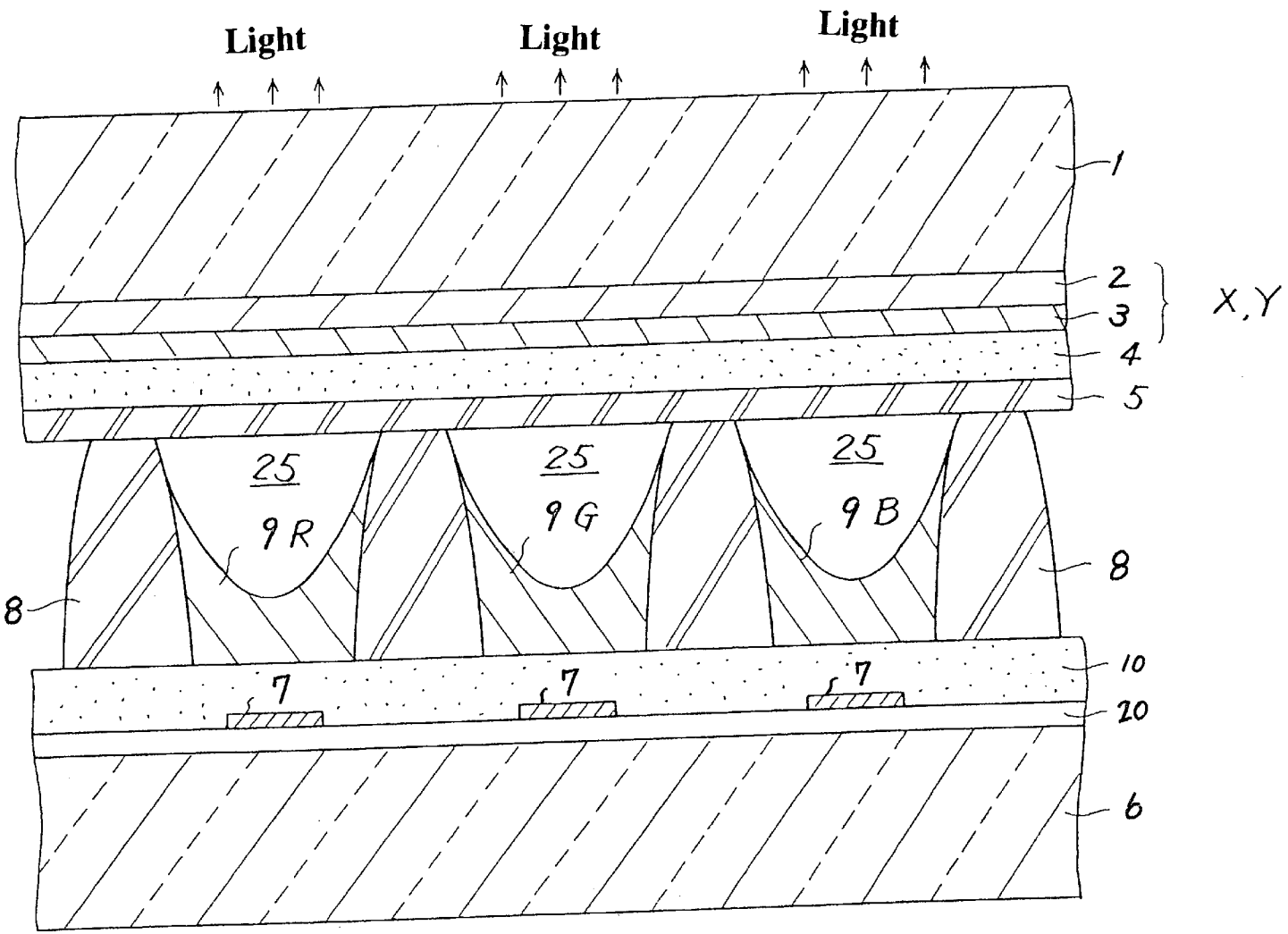
FIG. 2 is a cross-sectional view taken along a pair of PDP display electrodes.

FIG. 1 is an exploded perspective view of the schematic structure of a plasma display panel (hereinafter referred to also as a "PDP") of a three-electrode surface discharge type according to the present embodiment. FIG. 2 is a cross-sectional view taken along a pair of display electrodes of the PDP. The basic structure will now be described while referring to FIGS. 1 and 2.

A front glass substrate 1 is an insulating substrate on the display side; light is emitted upward through the glass substrate 1 in FIG. 1. A glass substrate 6 is a rear insulating substrate. It is not necessary for the rear substrate 6 to be transparent; it may be composed of a ceramic. On the back of the insulating glass substrate 1 on the display side are formed X and Y electrodes. The X and Y electrodes serve as a pair of display electrodes, each of which comprises a transparent electrode 2 and a highly conductive bus electrode 3. The X and Y electrodes are covered with a dielectric layer 4 of made glass having a low melting point, such as PbO, and a protective layer 5 made of MgO. The bus electrodes 3 are provided along the ends and on opposite sides of the X and Y electrodes, in order to compensate for the conductivity of the transparent electrodes 2. The transparent electrodes 2 are made of, for example, ITO, and the bus electrodes 3 have a three-layer structure of Cr/Cu/Cr, for example.

For the rear glass substrate 6, stripe shaped address electrodes 7 are formed on an underlayer of passivation film (not shown), which is, for example, silicon oxide film, and are covered with a dielectric layer (also not shown). The address electrodes 7 have a three-layer structure of, for example, Cr/Cu/Cr, and the dielectric layer is formed of low-melting-point glass, such as PbO. Stripe shaped partition walls (barrier ribs) 8 are formed adjacent to the address electrodes 7. The partition walls 8 are made of low-melting-point glass, such as PbO, and have two functions: the cutoff of an influence imposed on adjacent cells during address discharging, and the prevention of light crosstalk. Red, blue and green fluophors 9 are so painted between the barrier ribs 8 that they coat the address electrodes 7 and the surfaces of the barrier ribs 8..

As is shown in FIG. 2, when the display side substrate 1 and the rear substrate 6 are assembled together, there is a gap of approximately 100 $\mu$m between them. A discharge mixing gas, Ne+Xe, is injected into spaces 25 which are defined by the barrier ribs 8. In FIG. 2, the underlayer 20 and the dielectric layer 10 are shown.

Figure 3:
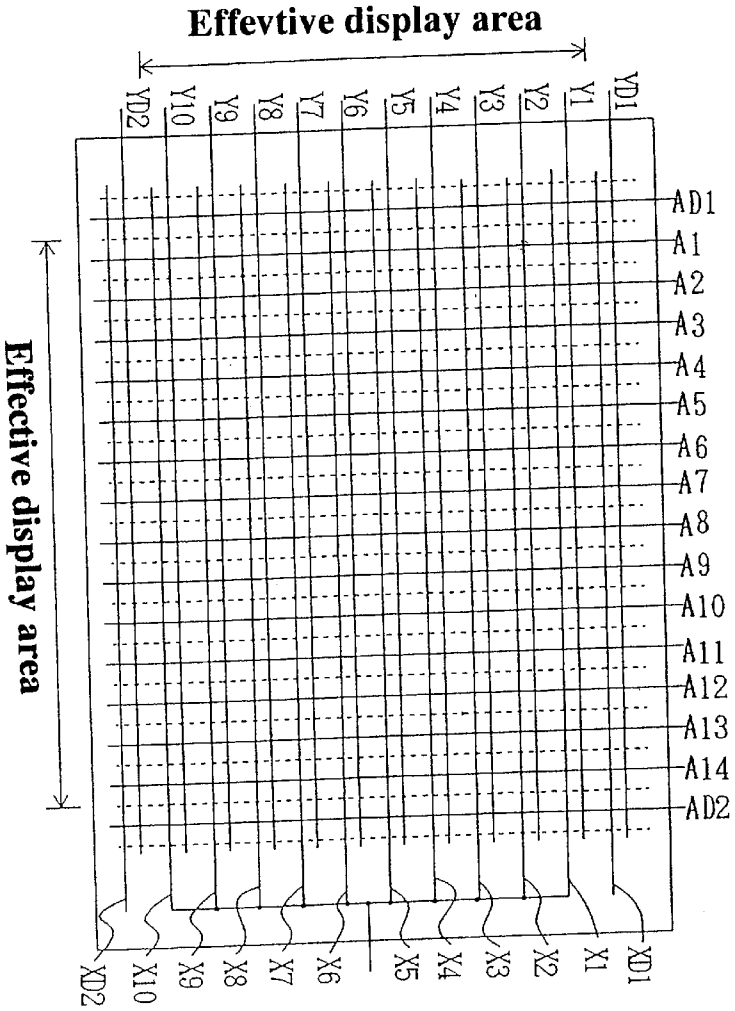
FIG. 3 is a plan view of a plasma display panel showing a relationship between X and Y electrodes, and address electrodes for the three-electrode surface discharge PDP.

FIG. 3 is a plan view of the three-electrode surface discharge PDP showing the relationship between the X and Y electrodes and the address electrodes 7. The X electrodes, X1 through X10, are arranged latitudinally in parallel and are collectively connected at the end of the substrate 1. The Y electrodes, Y1 through Y10, are located between the X electrodes, and are independently led out at the end of the substrate 1. The pairs of the X and Y electrodes form display lines, and a discharge sustaining voltage for a display is alternately applied to these pairs. XD1 and XD2, and YD1 and YD2 are dummy electrodes provided outside valid display areas in order to relax non-linear characteristics that appear as a result of a process used for manufacturing a peripheral portion of the panel. Although one dummy electrode or one pair of dummy electrodes is provided on the four sides of the panel in FIG. 3, a different number of dummy electrodes can be selected. The address electrodes, A1 through A14, are provided on the display side substrate 1, and intersect the X and Y electrodes.

The sustaining discharge voltage is alternately applied to the X and Y electrode pairs, and the Y electrodes are used as scan electrodes for writing data. The address electrodes are employed for writing data, and in consonance with-the data to be written, plasma discharges occur between the address electrode and the Y electrode to be scanned. Therefore, only a single cell discharge current is required to supply power to the address electrodes. Since the discharge voltage is determined in accordance with the voltage provided by combining the voltages of the address electrode and the Y electrode, the plasma display can be driven by a comparatively low voltage. By driving of the PDP with a small current at a low voltage, a large display screen is possible.

Wall charges, which have been generated by the address discharge occurring between the address electrodes 7 and the Y electrodes, remain on the dielectric layer 4, and are used to maintain a surface discharge between the pairs of display electrodes 2 and 3.

FIGS. 4A through 4D are cross-sectional views of a process for fabricating the rear glass substrate 6 according to a first embodiment of the present invention. In this embodiment, conductive material is contained in the partition wall layer 80, so that electric charges generated by collision electrification occurring during the sandblasting procedure are spread uniformly so as to provide a uniform etching rate. As a conductive organic material, for example, is selected as the conductive material, the conductivity of the material can be reduced or removed by an annealing procedure which is performed after the etching of the sandblasting procedure. In other words, the partition wall layer 80 is conductive during the sandblasting procedure, but after being annealed, the layer 80 becomes an insulating partition wall layer. The above conductive material will be described later in detail.

When polyaniline, a conductive organic polymer, is employed as a conductive material, it is generated in the following manner. First, a solution of N-methyl-2-pyrrolidone with the polyaniline of 5 wt % is spin-coated on the glass substrate 6 to form a thin film thereon. The glass substrate 6 coated with the polyaniline thin film is immersed in a 5% sulfuric acid solution at 40° C. for about 2 minutes, and is then rinsed with cold water. Since the glass substrate 6 has been immersed in a sulfuric acid solution, the polyaniline film acquires an electric charge and is doped to increase its conductivity. The polyaniline thin film which has conductivity, is scraped from the glass substrate 6, and is ground into powder. The powdery polyaniline of 5 wt % is added to a glass paste, such as lead oxide, that is a conventional partition wall material, and the obtained paste is used as a paste material for partition walls.

Figure 4A:
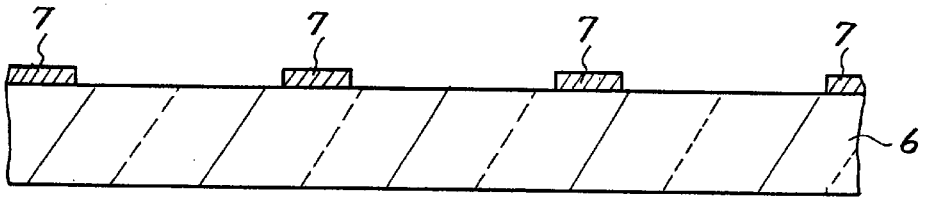
FIGS. 4A through 4D is a cross-sectional view of a process for manufacturing a rear glass substrate according to a first embodiment of the present invention.
Figure 4B:
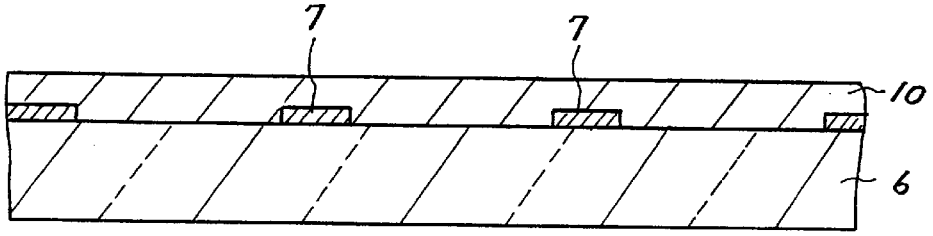

As is shown in FIG. 4A, an address electrode film having a three-layer structure of Cr/Cu/Cr is deposited on a passivation underlayer (not shown) on the glass substrate 6. The address electrode film is then patterned using the ordinary lithography procedure to form the address electrodes 7. Following this, as is shown in FIG. 4B, a low-melting-point glass layer, containing lead oxide as a primary element, of about 10 $\mu$m is formed, an is annealed to provide the dielectric layer 10.

Figure 4C:
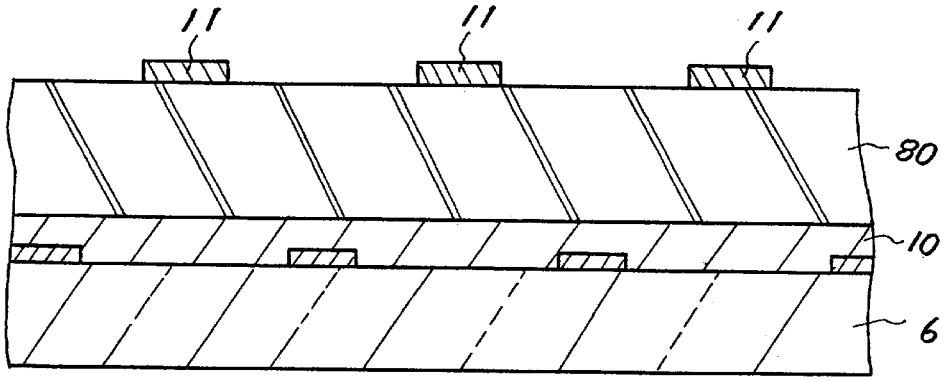
Figure 4D:
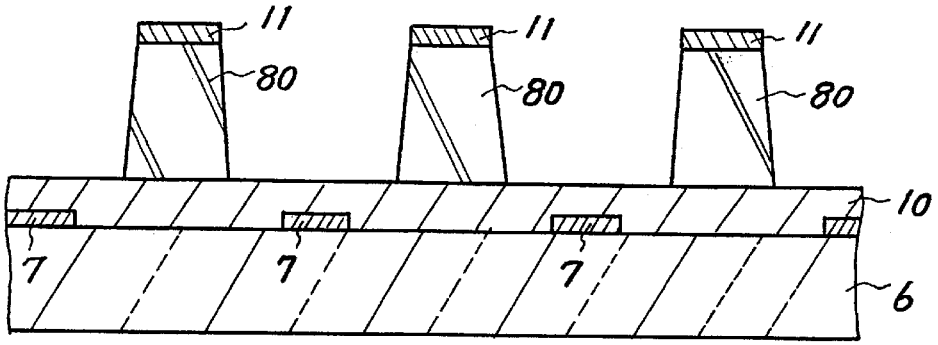

As is shown in FIG. 4C, the above partition wall material layer 80 added with the polyaniline is formed by a screen printing so that the thickness thereof would be about 130 $\mu$m under dry condition. The partition wall material layer 80 is then dried. Sequentially, a photosensitive dry film is adhered to the partition wall material layer 80, and is then exposed and developed by photolithography to provide mask film 11. The partition wall material layer 80 is patterned by the sandblasting using the mask film 11. In this patterning procedure, since the partition wall material layer 80 is conductive, electric charges can freely move through the layer 80, even though the collision electrification occurs. As a result, the electric charges are almost uniformly dispersed, and a difference in the etching rate, which is accompanied by a lack of uniformity in the charges, is eliminated. Consequently, as is shown in FIG. 4D, the partition walls 80 are formed with no residual substance remaining above the address electrodes 7.

The resultant structure is annealed at about 500° C. for about 60 minutes. During this process, polyaniline, which is the conductive organic polymer contained in the partition walls 80, is decomposed and changes into an insulating material. The present inventor performed thermogravimetric analysis (TGA) for the polyaniline film after annealing, and confirmed that the polyaniline film exposed at the annealing temperature was decomposed and its weight was changed. The annealing temperature is preferably 400° C. or higher when a conductive organic paste is used. When the glass substrate is employed, the annealing temperature preferably is lower than 600° C., while taking the possibility of damaging against the glass substrate into consideration. When a heat-resistant ceramic substrate is used as an insulating substrate, the annealing temperature can be increased to 1000° C. When the glass substrate is annealed at such a temperature, its conductivity is lost.

Then, red, blue and green fluophors are formed on the dielectric layer 10 and the partition walls 80 by printing, and degassing is performed. The rear glass substrate is thereafter completed.

Figure 5A:
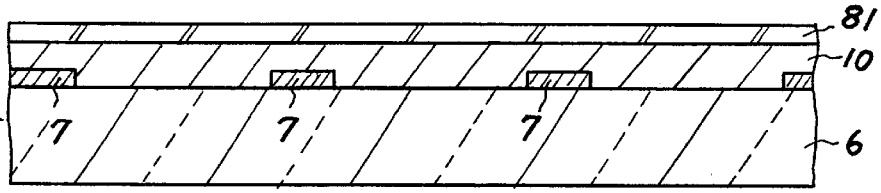
FIGS. 5A through 5C is a cross-sectional view of a process for manufacturing a rear glass substrate according to a second embodiment of the present invention.
Figure 5B:
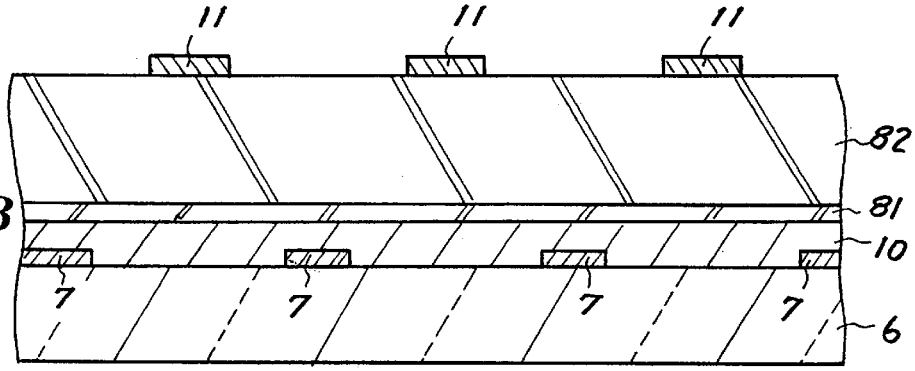
Figure 5C:
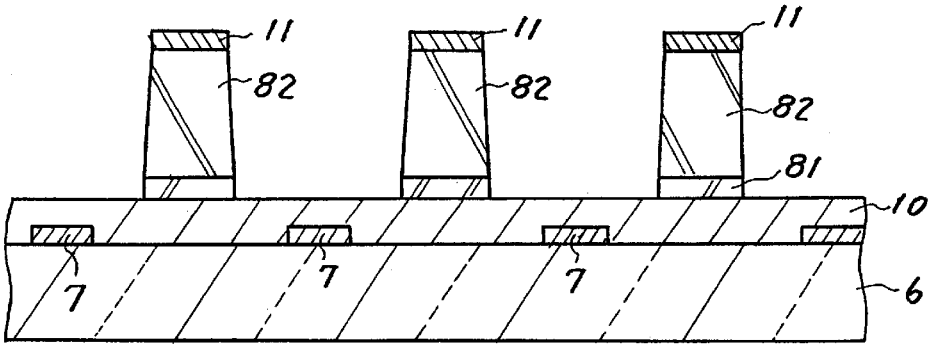
Figure 6A:
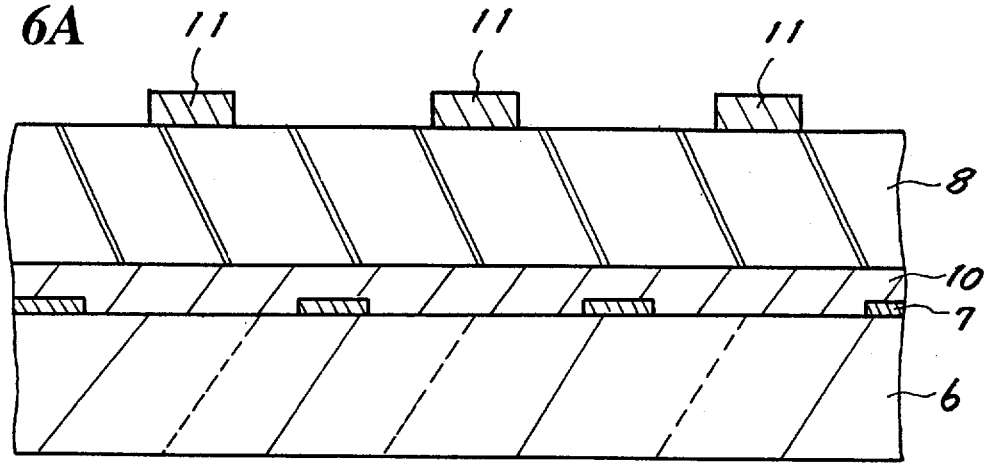
FIGS. 6A through 6B is a cross-sectional view of the essential portion showing a process for forming ordinary partition walls.
Figure 6A:
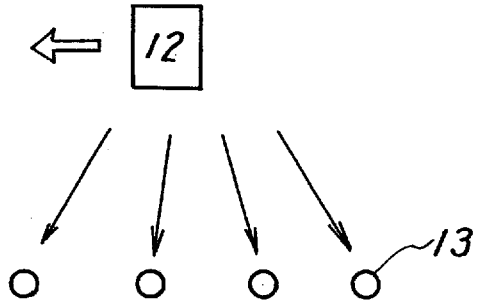
Figure 6B:
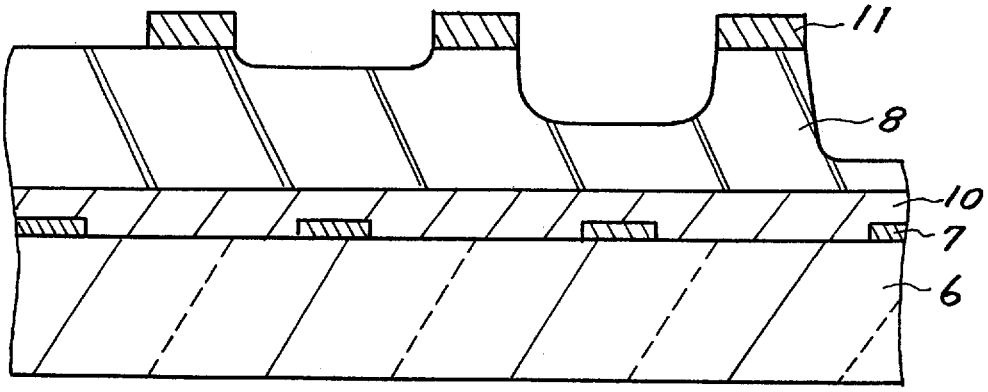
Figure 7:
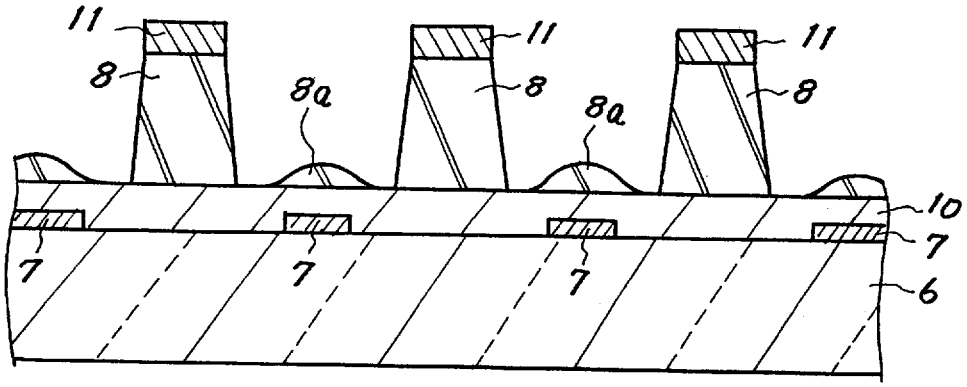
FIG. 7 is a cross-sectional view following the termination of the sandblasting.

FIGS. 5A through 5C are cross-sectional views of a process for fabricating a rear glass substrate according to a second embodiment of the present invention. In this embodiment, instead of adding conductive material to partition wall material, a conducive layer 81 is deposited between a conventional partition wall material layer and a dielectric layer 10, and after the sandblasting has been completed, is changed to non-conductive material by decomposition. The fabrication procedure employing this method is simpler than is the method wherein the partition wall contains conductive material.

As is shown in FIG. 5A, on the dielectric layer 10 is deposited the conductive layer 81 that includes 1 wt % of the above polyaniline powder dissolved into a solvent containing toluene as a primary element. Spin coating is employed for its deposition, the thickness of the layer 81 being approximately 0.5 $\mu$m.

As is shown in FIG. 5B, a low-melting-point glass paste, having as a primary element the equivalent amount of lead oxide to that in conventional cases, is printed on the conductive layer 81 to form a partition wall material layer 82 of 100 $\mu$m. After the partition wall material layer 82 has been dried, dry film masks 11 are deposited. Then, the partition wall layer 82 is etched by the previously mentioned sandblasting method. At this time, even when electrification occurs due to forcefully expelled particles striking the layer 82, the presence of the conductive layer 81 permits the free movement of electric charges generated by the electrification, and thus, the uniformity of the etching rate is maintained.

As is shown in FIG. 5C, therefore, partition walls 82 are provided with no residual substance remaining above the address electrodes 7. The partition walls 82 are annealed by being exposed to a 580° C. annealing atmosphere for 30 minutes. As a consequence of being exposed to the annealing temperature, the conductive material 81 containing polyaniline is decomposed and changed to insulating material. As is described above, it is preferable that this annealing temperature be from 400° to 600° C for a glass substrate, and from 500° to 1000° C. for a ceramic substrate. Following this, in the same manner as in the first embodiment, red, blue and green fluophor layers are printed and degassing is performed. In this manner, the rear substrate is provided. Finally, when the rear substrate and the front substrate are sealed with glass while facing each other, a discharge gas, such as Ne and Xe, is injected therein, and the aging procedure is performed to complete a plasma display panel.

[Conductive material]

In the above embodiments, an example has been explained where polyaniline organic polymer is used as a conductive material. Another example using a different material will now be described.

Instead of organic polymer, charge transfer complexes comprising an electron donor and an electron acceptor can be used. It is also known that by exposing such a substance to the annealing temperature it is decomposed and its conductivity is lost. For this to occur, an annealing temperature of 500° C or higher is preferable. The desirable annealing temperature for a glass substrate is 500° to 600° C., and for a ceramic substrate 500° to 1000° C.

The above described organic conductive material is decomposed during the performance of the annealing process for the partition walls and is changed to insulating material. However, so long as the conductivity of the wall partitions is too small to affect the electric characteristics of the plasma display panel, such partition walls can be employed. In this case, conductive oxide or metal, or a mixture of them can be used as the conductive material.

Even the conductive oxide material is changed to an insulating material by changing the structure of its oxygen bond during the performance of the partition wall annealing process, and the metal material is oxidized so that it is changed to insulating material during the annealing process. Therefore, in either process shown in FIGS. 4 or 5 that is employed, the conductivity is high during the sandblasting procedure and is lowered after the annealing process has been performed.

An appropriate organic polymer material is polyaniline, polythiazyl, polyacetylene, poly-p-phenylene(PPP), poly-p-phenylenesulfide(PPS), polyphenyleneoxide(PPO), polyvinylenesulfide(PVS), polybenzothiofide, poly-p-phenylenevinylene, poly(2,5-thienylene-vinylene), polyazulene, polypyrrole, polythiophene, polythiophenevinylene, polyselenophene, polyfuran, poly (3-alkylthiophene)polyfuran, polytriphenylamine-polypyridinopyridine, polypyrazinopyrazine, polymethylimine, polyoxadiazole, or these delivertives, or a mixture of two or more of these materials.

An appropriate example of organic material using charge transfer complexes includes an electron donor, having tetrathiafulvalence(TTF), tetrathiotetracene, tetramethyltetraselenafulvalene(TMTSF), phenothiazyl, one, or two or more types of these affined elements, and an electron acceptor having tetracyanoquinodimethane, fluoranyl, trinitrofluorenone, hexacyanobutadiene, or one, or two or more of these affined elements.

In addition, an example of the above conductive oxide material includes one, or two or more elements selected from among the elements $SnO_2$, $In_2O_3$, $Tl_2O_3$, TlOF, $SrTiO_3$, $ReO_3$, TiO, $LaNiO_3$, $LaCuO_3$, $CuRuO_3$, $SrIrO_3$, $SrCrO_3$, $RuO_2$, $OSO_2$, $IrO_2$, $MoO_2$, $WO_2$, $ReO_2$, $RhO_2$, $\beta PtO_2$, $V_2O_3$, $Fe_3O_4$, $VO_2$, $Ti_2O_3$, VO, $Cr0_2$, $SrVO_3$, $CaCrO_3$, $CaFeO_3$, $SrFeO_3$, $SrCoO_3$, $LaCoO_3$, $LuNiO_3$, $CaRuO_3$, $SrRuO_3$, $La_2NiO_4$, $Nd_2NiO_4$, CaO and NiO.

Mo is an appropriate choice for the metal material. The metal material is preferably the one that is changed to an insulating oxide during the performance of the annealing process.

As a comparison, the present inventor deposited a partition wall layer 80 containing conductive polyaniline, shown in FIG. 4C, on a first sample in which address electrodes 7 were formed, and on a second sample in which address electrodes 7 were not formed. As a third sample, the present inventor formed on address electrodes 7 a partition wall layer 80 having no conductive material. The three samples were etched using the sandblasting method. No residual substance was found on the first and the second samples, while a residual substance was found on the third sample. It was confirmed that so long as the partition wall layer containing conductive material is used, a uniform etching rate (sandblasting rate) can be maintained regardless of whether the address electrodes are present.

As is described above, according to the present invention, even when electric charges are generated during the sandblasting procedure for forming the partition walls (barrier ribs) of a plasma display panel, they can be dispersed via the conductive material. As a result, a uniform sandblasting rate (etching rate) can be maintained regardless of whether the address electrodes are present. Therefore, a uniform cell structure can be acquired, which contributes greatly to the enhancement of the performance of a plasma display panel.

What is claimed is:

1. A method, for manufacturing a plasma display panel that has a pair of insulating substrates facing each other with an intervening discharge space and that provides a display by generating a discharge of plasma between electrodes formed on said insulating substrates, comprising the steps of:

forming a plurality of electrodes on said insulating substrates;

forming a conductive paste layer on said insulating substrates;

forming a masking film on said paste layer at locations between said plurality of electrodes;

forcefully impelling particles against said paste layer to remove, by etching, portions of said paste layer where said masking film is not formed; and exposing said paste layer to an annealing atmosphere so as to form partition walls between said plurality of electrodes.

2. A method for manufacturing a plasma display panel according to claim 1, wherein conductivity is reduced at said step at which said paste layer is exposed to said annealing atmosphere.

3. A method for manufacturing a plasma display panel according to claim 2, wherein said conductive paste layer includes conductive material.

4. A method, for manufacturing a plasma display panel that has a pair of insulating substrates facing each other with an intervening discharge space and that provides a display by generating a discharge of plasma between electrodes formed on said insulating substrates, comprising the steps of:

forming a plurality of electrodes on said insulating substrates;

forming a conductive thin film on said insulating substrates;

forming a paste layer on said conductive thin film;

forming a masking film on said paste layer at locations between said plurality of electrodes;

forcefully impelling particles against said paste layer to remove, by etching, portions of said paste layer where said masking film is not formed; and exposing said paste layer to an annealing atmosphere so as to form partition walls between said plurality of electrodes.

5. A method for manufacturing a plasma display panel according to claim 4, wherein conductivity is reduced at said step at which said paste layer is exposed to said annealing atmosphere.

6. A method for manufacturing a plasma display panel according to claim 5, wherein said conductive thin film includes conductive material.

7. A method for manufacturing a plasma display panel according to claim 6, wherein said conductive material contains organic polymer.

8. A method for manufacturing a plasma display panel according to claim 6, wherein said organic polymer is polyaniline, polythiazyl, polyacetylene, poly-pphenylene (PPP), poly-p-phenylenesulfide(PPS), polyphenyleneoxide (PPO), polyvinylenesulfide(PVS), polybenzothiofide, poly-p-phenylenevinylene, poly(2,5-thienylene-vinylene), polyazulene, polypyrrole, polythiophene, polythiophenevinylene, polyselenophene, polyfuran, poly.(3-alkylthiophene)polyfuran, polytriphenylamine-polypyridinopyridine, polypyrazinopyradine, polymethylimine, polyoxadiazole, or delivertives of the above, or a mixture of two or more of these materials.

9. A method for manufacturing a plasma display panel according to claim 5, wherein said conductive material includes organic charge transfer complexes including an electron donor and an electron acceptor.

10. A method for manufacturing a plasma display panel according to claim 9, wherein said organic charge transfer complexes including an electron donor, having tetrathiafulvalene(TTF), tetrathiotetracene, tetramethyltetraselenafulvalence(TMTSF), phenothiazyl, one, or two or more types of these affined elements, and an electron acceptor having tetracyanoquinodimethane, fluoranyl, trinitrofluorenone, hexacyanobutadiene, or one, or two or more of these affined elements.

11. A method for manufacturing a plasma display panel according to claim 5, wherein said conductive material includes conductive oxide material.

12. A method for manufacturing a plasma display panel according to claim 11, wherein said conductive oxide material comprising one, or two or more elements selected from among the elements $SnO_2$, $In_2O_3$, $Tl_2O_3$, TlOF, $SrTiO_3$, $ReO_3$, TiO, $LaNiO_3$, $LaCuO_3$, $CuRuO_3$, $SrIrO_3$, $SrCrO_3$, $RuO_2$, $OSO_2$, $IrO_2$, $MoO_2$, $WO_2$, $ReO_2$, $RhO_2$, $\mu PtO_2$, $V_2O_3$, $Fe_3O_4$, $VO_2$, $Ti_2O_3$, VO, $CrO_2$, $SrVO_3$, $CaCrO_3$, $CaFeO_3$, $SrFeO_3$, $SrCoO_3$, $LaCoO_3$, $LuNiO_3$, $CaRuO_3$, $SrRuO_3$, $La_2NiO_4$, $Nd_2NiO_4$, CaO and NiO.

13. A method for manufacturing a plasma display panel according to claim 5, wherein said conductive material contains metal material.

14. A method for manufacturing a substrate assembly for a plasma display panel, said substrate assembly having an insulating substrate, a plurality of electrodes elongating in parallel on the substrate, and a plurality of stripe shaped barrier ribs which elongate in parallel to said electrode on said substrate so as to sandwich the electrode and which define elongated cavities along the electrodes therebetween, said method including steps of:

forming said plurality of electrodes on said insulating substrate;

forming a conductive paste layer on said insulating substrate; forming a mask layer on the paste layer at locations between the plurality of electrodes;

impelling particles against the paste layer to etch portions of the paste layer where the mask layer is not formed; and exposing the paste layer to an annealing atmosphere so as to form said barrier ribs between said plurality of electrodes.

* * * * *

UNITED STATES PATENT AND TRADEMARK OFFICE

CERTIFICATE OF CORRECTION

PATENT NO. : 5,860,843

DATED : January 19, 1999

INVENTOR(S) : Kasahuara

It is certified that error appears in the above-identified patent and that said Letters Patent is hereby corrected as shown below:

IN THE DRAWINGS, Fig. 2, change "Effevtive" to --Effective--.

Col. 3, line 26, change "is a" to --are--; change "view" to --views--;

line 30, change "is a" to --are--; change "view" to --views--;

line 33, change "is a" to --are--; change "view" to --views--.

Col. 4, line 50, delete "-".

Col. 9, line 1, change "poly-pphenylene" to --poly-p-phenylene--;

line 9, change "delivertives" to --derivatives--.

Col. 10, line 2, change " $\mu PtO_2$" to --$\beta PtO_2$--;
line 21, start a NEW PARAGRAPH with "forming".

Signed and Sealed this

Twenty-second Day of June, 1999

*Attest:*

Q. TODD DICKINSON

*Attesting Officer*

*Acting Commissioner of Patents and Trademarks*